166-66 SR
M7219 XR 4,098,342

United States Patent [19]
Robinson et al.

[11] 4,098,342
[45] Jul. 4, 1978

[54] METHOD AND APPARATUS FOR MAINTAINING ELECTRIC CABLE INSIDE DRILL PIPE

[75] Inventors: Leon H. Robinson; Jerry M. Speers; Adelbert Barry, all of Houston; Daniel J. Campbell, Bellaire, all of Tex.

[73] Assignee: Exxon Production Research Company, Houston, Tex.

[21] Appl. No.: 800,367

[22] Filed: May 25, 1977

[51] Int. Cl.[2] ..... E21B 7/00; E21B 47/12
[52] U.S. Cl. ..... 166/315; 166/65 R; 166/250; 174/47; 175/40; 175/57; 175/320
[58] Field of Search ..... 175/57, 40, 50, 104, 175/320; 174/47; 339/16 R; 166/250, 67, 315, 72, 65 R, 64, 242

[56] References Cited

U.S. PATENT DOCUMENTS

| | | | |
|---|---|---|---|
| 2,096,359 | 10/1937 | Hawthorn | 339/16 R X |
| 2,748,358 | 5/1956 | Johnson | 339/16 R |
| 3,253,245 | 5/1966 | Brandt | 339/16 R |
| 3,696,332 | 10/1972 | Dickson, Jr. et al. | 175/104 X |
| 3,825,078 | 7/1974 | Heilhecker et al. | 175/57 |
| 3,825,079 | 7/1974 | Heilhecker | 175/57 |
| 3,918,537 | 11/1975 | Heilhecker | 174/47 X |
| 3,926,269 | 12/1975 | Cullen et al. | 175/57 X |
| 3,957,118 | 5/1976 | Barry et al. | 174/47 X |

*Primary Examiner*—Stephen J. Novosad
*Attorney, Agent, or Firm*—Michael A. Nametz

[57] ABSTRACT

An insulated electric conductor employed in a tubular drill string to transmit electric energy between subsurface and surface locations is arranged within the drill string in a convoluted configuration to provide an excess length of conductor. The convoluted conductor is prevented from entangling during drilling by rotation limiting assemblies mounted in the drill string over a selected interval.

13 Claims, 10 Drawing Figures

METHOD AND APPARATUS FOR MAINTAINING ELECTRIC CABLE INSIDE DRILL PIPE

BACKGROUND OF THE INVENTION

1. Field of the Invention

This invention relates to an improved method for establishing and maintaining electric continuity through a drill string using an insulated electric conductor. In one aspect, it relates to a method and apparatus for preventing the cable stored in a rotary drill string from twisting or snarling attendant to drilling operations.

2. Description of the Prior Art

In the drilling of oil wells, gas wells, and similar boreholes, it frequently is desirable to transmit electric energy between subsurface and surface locations. One application where electrical transmission has received considerable attention in recent years is in wellbore telemetry systems designed to sense, transmit, and receive information indicative of a subsurface condition. This operation has become known in the art as "logging while drilling."

A major problem associated with wellbore telemetry systems has been that of providing reliable means for transmitting an electric signal between the subsurface and surface locations. This problem can best be appreciated by considering the manner in which rotary drilling operations are normally performed. In conventional rotary drilling, a borehole is advanced by rotating a drilling string provided with a drill bit at its lower end. Lengths of drill pipe, usually about 30 feet long, are added to the drill string, one at a time, as the borehole is advanced in increments. In adapting an electric telemetry system to rotary drilling equipment, the means for transmitting the electric signal through the drill string must be such to permit the connection of additional pipe lengths to the drill string as the borehole is advanced.

An early approach to the problem involved the use of continuous electric cable which was adapted to be lowered inside the drill string and to make contact with a subsurface terminal. This technique, however, required withdrawing the cable from the drill string each time a pipe length was added to the drill string. Another approach involves the use of special drill pipe. Each pipe section of the special pipe is provided with an electric conductor having connectors at its opposite ends. Electric continuity is maintained across the junction of two pipe sections by connectors of one section contacting a connector on the adjacent pipe section (see U.S. Pat. Nos. 3,518,608 and 3,518,609). Disadvantages of this system include the high cost of the special pipe sections, the need for a large number of electric connections (one at each joint), and the difficulty of maintaining insulation of the electric connectors at each joint.

Still another approach involves the use of cable sections mounted in each pipe section (See U.S. Pat. No. 2,748,358). The cable sections are connected together as pipe sections are added to the drill string. Each cable section is normally made slightly longer than its associated pipe section, with the result that a small amount of slack is present in the conductor string at all times. Drilling fluid flowing through the drill string exerts a fluid drag on the loose cable which tends to damage the connectors or snarl the cable.

A more recent development in cable systems for wellbore telemetry operations is described in U.S. Pat. No. 3,825,078 on "Method of Mounting and Maintaining an Electric Conductor in a Drill String." The cable system disclosed in this patent employs a looped cable which permits the cable string to be extended as the drill string is lengthened. Experience with this system has indicated that the overlapped cable sometimes becomes entangled as a result of pipe rotation or fluid flow in the pipe string.

A method for preventing looped cable from tangling is described in U.S. Pat. No. 3,825,079 on "Method For Mounting An Electric Conductor In A Drill String". In accordance with one embodiment of this patent, entanglement of the overlapped cable is minimized by providing a track between a fixed upper support and lower axially movable weight. The support and weight maintain the cable in an overlapped configuration, allowing stored cable to be withdrawn as drilling progresses, but minimizes twisting of the looped cable. However, this system is cumbersome since it requires long track sections which must be lowered into and withdrawn from the pipe string. Furthermore, this somewhat limits the length of cable which can be stored.

SUMMARY OF THE INVENTION

The purpose of the present invention is to provide an electric circuit between a subsurface location in a well and the surface, thereby permitting the monitoring of a subsurface condition during drilling operations. In particular, the invention contemplates an improved method and apparatus preventing cable entanglement in a looped cable system.

The cable extends within the pipe string from a subsurface location around an upper support assembly and a lower pulley assembly to the surface, thereby storing excess length of cable in the drill string.

A novel aspect of the present invention resides in the provision of a long weight on the lower pulley assembly which is prevented from rotating relative to the pipe string by special shaped guide assemblies mounted at spaced intervals along the drill string. The weight is longer than the distance between adjacent guide assemblies so that relative rotation of the weight is prevented during drilling operations, but axial movement is permitted. A plurality of guide assemblies are provided and preferably are installed at every pipe joint over an appropriate interval of the pipe string. A limiting ring is positioned in the drill string below the weight and serves to prevent the weight from dropping below the guide interval.

The upper support assembly is secured to the drill string. By preventing relative rotation of the weight, the lower pulley assembly and upper support assembly are maintained in general proper alignment thereby preventing cable in the looped interval from entangling.

The method involves spacing a plurality of guide assemblies in a pipe string over the desired interval, placing an electric cable within the pipe string to extend from a subsurface location substantially to the surface, and providing an overlapped cable configuration by arranging the cable about an upper support assembly and a lower pulley assembly to which is attached a long weight. As the drilling operations proceed, the drill string is lengthened. The overlapped cable portions provide stored cable which can be fed upwardly through individual pipe sections added to the pipe string.

An important advantage of the method and apparatus of the present invention over prior art techniques is that rotation of the upper support assembly and lower pulley assembly relative to each other and the drill string is prevented, thereby preventing cable entanglement, without the necessity of using an excessively long track means.

DESCRIPTION OF THE PREFERRED EMBODIMENTS

Figure 1:
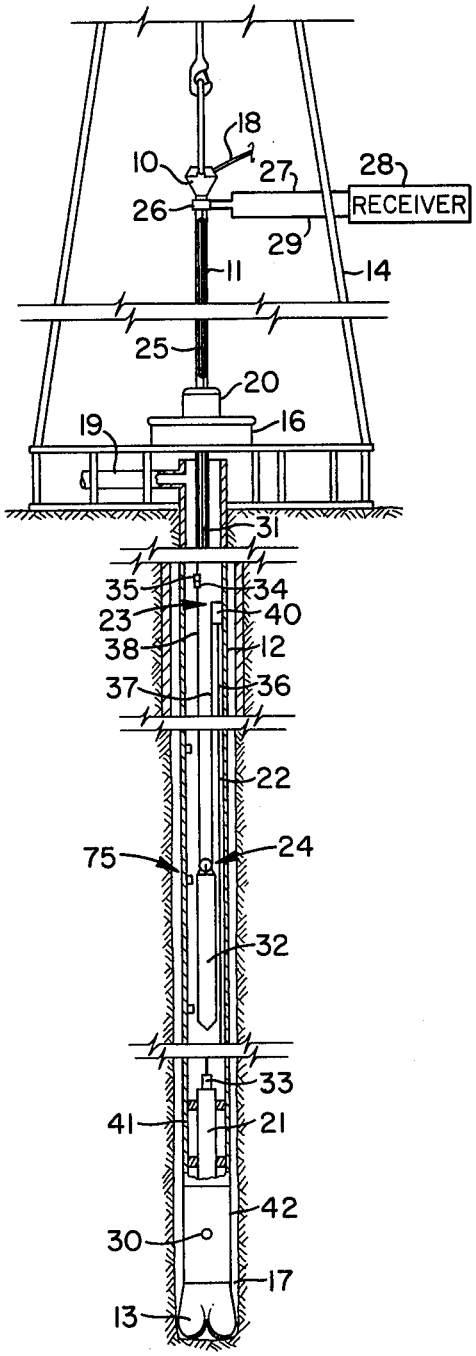
FIG. 1 is a schematic view of well drilling equipment provided with an electric conductor for transmitting an electric signal between a subsurface location and the surface.

Conventional rotary drilling equipment, as schematically illustrated in FIG. 1, includes swivel 10, kelly 11, tubular drill string 12, and bit 13. The lower portion of the drill string 12 and bit 13 are shown enlarged to better illustrate the invention. These components, connected in the manner illustrated, are suspended from the drilling derrick 14 by means of rig hoisting equipment. The kelly 11 passes through rotary table 16 and connects to the upper end of the drill string 12. The term "drill string" as used herein refers to the column of tubular pipe between the bit 13 and the kelly 11; and the term "pipe string" refers to the complete pipe column including the kelly 11. The major portion of the drill string 12 normally is composed of drill pipe with a lower portion being composed of drill collars. The drill string 12 consists of individual pipe sections, either drill pipe or drill collars, connected together in end-to-end relation.

The borehole 17 is advanced by rotating the drill string 12 and bit 13 while at the same time drilling fluid is pumped through the drill string 12 and up the borehole annulus. The drilling fluid is delivered to swivel 10 through a hose (not shown) attached to hose connection 18 and is returned to the surface fluid system through pipe 19. A kelly bushing 20 couples the rotary table 16 to the kelly 11 and provides means for transmitting power from the rotary table 16 to the drill string 12 and bit 13. It should be noted that the use of a power swivel eliminates the need for the kelly and rotary table. The present invention may also be used in systems which employ a power swivel in lieu of a kelly and rotary table; for purposes of illustration, however, the present invention is described in connection with the kelly and rotary table arrangement.

As mentioned, previously, it frequently is desirable to monitor a subsurface drilling condition during drilling operations. This requires measuring a physical condition at the subsurface location, transmitting this data as an electric signal to the surface, and reducing the signal to useful form. Typical situations where telemetry is applicable in drilling operations include drilling through abnormal pressure zones, drilling through zones where hole deviation is likely to be a problem, directional drilling, exploratory drilling, and the like.

Although the present invention may be employed in almost any drilling operation wherein an electric conductor is used in tubular pipe to transmit electric energy between a subsurface and surface location, it finds particularly advantageous application in a wellbore telemetry system such as that illustrated in FIG. 1 which comprises an instrument 21, cable 22, and receiver 28. The term "cable" as used herein in connection with telemetry refers to any size electric conductor. Such cables include insulated single-conductor cable or multi-conductor cable. Wellbore telemetry cable preferably is armored with wire or bands.

The instrument 21 capable of measuring a subsurface condition and generating an electric signal indicative or representative of that condition is mounted above bit 13 in the drill string 12. A variety of devices capable of sensing a physical condition are available. These include transducers for measuring pressure, temperature, strain, and the like; instruments for measuring mud properties such as electrical resistivity, density or gas content; surveying instruments for measuring hole deviation; and logging instruments for measuring resistivity or other properties of subsurface formations. The instrument 21 may be powered by batteries or by energy transmitted through cable 22. Alternatively, a subsurface generator driven by fluid flowing through the drill string 12 may be used to power instrument 21.

The energy transmitted through cable 22 may be a signal generated by the subsurface instrument 21 and transmitted to the receiver 28 at the surface. Alternatively, the energy may be electric power transmitted from the surface to actuate or drive a subsurface instrument or motor. Also, energy may be transmitted down the cable 22 to power the instrument 21, and simultaneously intelligence may be transmitted up the same conductor.

In telemetry operations, it is preferred that the energy being transmitted be in the form of a pulsating signal. Information can be transmitted by varying the number, amplitude, width or spacing of a train of electric pulses, or it can be transmitted by modulating the frequency or amplitude of the pulsating signal. More than one transducer or other device may be employed in the system, in which case a multiplexer may be used for sending the various signals over a single conductor.

In the preferred embodiment of the present invention a portion of the cable 22 is maintained in tension. As schematically illustrated in FIG. 1, the cable 22 extends from instrument 21 around upper support assembly 23 and lower pulley assembly 24 disposed in the drill string 12, and to the surface where it connects to kelly cable 25. In this embodiment, the kelly cable 25 extends through the kelly 11 and connects to a terminal located at the upper end of the kelly 11. It should be observed, however, that cable 25 may be embedded in the kelly 11, in which case the cable 22 will extend to the upper end of the drill string 12 and connect to kelly cable 25 at that location. In order to facilitate the addition of pipe sections to the drill string 12, however, it is preferred that the kelly cable 25 extend through the interior of the kelly 11 and have a tail portion 31 which extends slightly more than the length of one pipe section below the lower end of kelly 11. This arrangement is illustrated and discussed in length in U.S. Pat. No.

3,825,078.

If telemetry operations are to be performed while the kelly 11 and drill string 12 are rotating, the upper end of the kelly cable 25 will be connected to a device 26 capable of transmitting electric energy from a rotating member to a stationary member. Device 26 may be a rotary transformer having a rotor secured to the kelly 11 and a stator secured to the stationary portion of the swivel 10, or it may be a slip ring and brush assembly. Device 26 and electric conductor 27 provide means for transmitting signals from the cable 22 within the pipe string to receiver 28. The return path for the electric circuit may be provided by a variety of grounding circuits but preferably is through the pipe string or conductor armor. Conductor 29, part of the return path, interconnects stationary portion of device 26 and receiver 28. If telemetry operations are to be performed at times when the drill string 12 and kelly 11 are stationary, device 26 will not be needed and the conductors 27 and 29 may be connected directly to cable 22 and ground through a suitable connector. In this situation, conductors 27 and 29 will be disconnected when the kelly 11 and drill string 12 are in use. Other means for transmitting the signal to the receiver 28 include a wireless transmitter connected to cables 22 or 25 and located on a rotating member, e.g. kelly 11.

The receiver 28 is an instrument capable of receiving the signal generated by instrument 21 and reducing it to useful form.

As mentioned previously, the apparatus for maintaining the cable 22 in the overlapped configuration includes an upper support assembly 23 and a lower pulley assembly 24. The cable 22 at its lower terminal end is provided with a connector 33 for attachment to the instrument 21. The cable 22 extends from the instrument upwardly to and around the upper support assembly 23, down to and around the lower pulley assembly 24, and upwardly to the surface where its upper terminal end is provided with a connector 34 adapted to mate with a connector 35 on the tail portion 31 of kelly cable 25. This arrangement provides the cable with three overlapped portions 36, 37, and 38.

The upper support assembly 23 is mounted on the pipe string 12 and the lower pulley assembly 24 is supported on a looped portion of the cable 22. As will be described in more detail below, a long weight 32 is rigidly attached to the lower pulley assembly 24. Weight 32 is preferrably a relatively flat rigid member. Each joint of the pipe string 12 between the weight 32 and the upper support assembly 23 is provided with a guide assembly 75 which is specially shaped to limit rotational movement of the weight 32 relative to the pipe string. The weight 32 maintains tension on overlapped cable portions 37 and 38 and is prevented from rotating during rotary drilling by means of the guide assemblies. However, the lower pulley assembly 24 and weight 32 remain free to move up or down within the pipe string 12, permitting withdrawal of cable 22 at the surface for introduction of additional cable.

With the telemetry equipment arranged as illustrated, "logging while drilling" operations may be conducted. A transducer or other sensing element 30 may be mounted in sub 42 and disposed to detect a condition, e.g. pressure, temperature, or mud property, in wellbore 17. The measured intelligence is converted to an electric signal in instrument 21 and transmitted via conductors 22, 25, and 27 to receiver 28 which converts the intelligence to useful engineering units. The telemetry operations may be performed as drilling is in progress. The drill string 12 including guide assemblies 75 and downhole telemetry equipment, including cable 22, support assembly 23, pulley assembly 24 and weight 32 are turned as a unit at drilling rotational speeds which range between about 50 and about 200 rpm.

When it becomes necessary to lengthen the drill string 12, telemetry and drilling operations are momentarily interrupted and a pipe section is introduced into the drill string 12 by the following procedure. The drill string 12 is suspended in the rotary table 16; kelly 11 is disconnected from the drill string 12 and elevated until connectors 34 and 35 are withdrawn. This raises the lower pulley assembly 24, and shortens the lengths of overlapped portions 36, 37, and 38. Connectors 34 and 35 are separated, and with connector 34 supported on the upper end of the drill string 12, the tail portion 31 of kelly cable 25 is threaded through the pipe section to be added. The kelly 11 is then connected to the upper end of the additional pipe section. This assembly is elevated above the pipe string 12. After reconnecting the connectors 34 and 35, the additional pipe section is screwed into the drill string 12 placing the equipment in condition to resume drilling and telemetry operations.

The overlapped cable configuration thus stores excess lengths of conductor within the pipe string 12. The amount of excess cable is equal to the combined length of overlapped cable portions 37 and 38. The excess cable is used up in increments as each additional pipe section is added. When the excess lengths of conductor are used up, as when the lower pulley assembly 24 reaches upper support assembly 23, the conductor system normally will be withdrawn from the drill string.

In order for the telemetry system to operate for long intervals, it is desirable to store as much conductor as possible in the pipe string which results in long lengths of cable portions 37 and 38. Experience with this type of system has shown that long lengths of overlapped cable tend to become entangled due to rotational action of the pipe string on the free hanging lower pulley assembly 24.

The present invention is concerned with maintaining the integrity of the electric cable 22 within the pipe string 12 during drilling operations. Previously, it has been found that by maintaining cable section 36 in tension, entanglement of the looped cable portions was reduced, but not eliminated. In U.S. Pat. No. 3,957,118, a cable gripping device for tensioning cable section 36 was described which allowed upward movement of section 36 but prevented downward movement. It has now been discovered that entanglement of the cable can be eliminated by providing means to prevent the lower pulley assembly 24 from rotating both with respect to the upper support assembly 23 and the pipe string 12. In a preferred embodiment of the invention, tension on cable section 36 is maintained by means of a cable gripping device.

The preferred embodiment of the present invention provides means on the lower pulley assembly 24 and on pipe string 12 for limiting the rotation of the lower pulley assembly 24, including a flat weight 32 attached to assembly 24 having a length greater than a length of a single pipe section. The pipe string 12 is provided with guide assemblies 75 which are mounted on selected pipe joints over the initial interval of the looped cable portions. The guide assemblies 75 operate in conjunction with the weight 32 when drilling to prevent twisting of cable portions 36, 37 and 38.

Briefly, the telemetry system is installed by first placing in the borehole 17 the drill string 12, which has been provided with guide assemblies 75 at selected pipe joints over the cable storage interval, sub 41 in which instrument 21 is mounted, and sub 42; lowering the cable 22, provided with lower connector 33, within the drill string 12; and, engaging connector 33 to instrument 21, which not only provides electrical contact therewith but also anchors the cable 22 thereto. The cable 22 is then reeved around the upper support assembly 23 which includes the cable gripping device 40, and around the lower pulley assembly 24 to which is attached flat weight 32. With the cable system in the drill string 12, a force is pulled on the cable 22 placing the entire cable, including portion 36, in tension. When this pulling force is released, the cable gripping device 40 maintains the tension on cable portion 36. The telemetry and drilling equipment are connected permitting "logging while drilling" operations to be carried out. As drilling proceeds and as additional pipe sections are required, each pipe section may be introduced into the pipe string as needed and the overlapped sections pulled upwardly through the added pipe sections in the manner described previously. This process may be continued until the excess cable is used up which will occur when the lower pulley assembly 24 reaches the upper support assembly 23. At that time, the cable 22 may be withdrawn by pulling an upward force at the surface. Initially the spider which mounts the upper support assembly 23 in the drill string 12 is released and, when a predetermined cable tension is reached, the connector 33 disengages from the instrument 21, permitting the entire assembly to be retrieved.

Figure 2A:
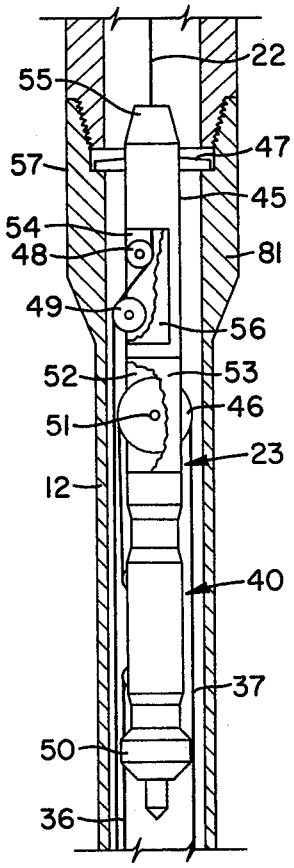
FIGS. 2A and 2B taken together illustrate a sectional, side elevational view of apparatus constructed according to the present invention and usable in wellbore telemetry operations.

As best seen in FIG. 2A, the upper support assembly 23 comprises an elongated body 45, a sheave 46 journaled to body 45, support arms 47, and guide rollers 48 and 49. The sheave 46 is mounted for free-wheel rotation on shaft 51 and is disposed within opening 52 formed in the body 45. The outer side of the opening 52 is closed by panel 53 (shown cutaway in FIG. 2A).

The sheave 46 has a grooved outer periphery for retaining cable 22. Its pitch diameter is sufficiently small to fit within the drill string 12 but large enough to permit the cable 22 to be bent therearound without kinking. The rollers 48 and 49 are mounted for free-wheel rotation in an opening 54 formed in body 45 at a location above the sheave opening 52 but angularly offset therefrom. Opening 54 is closed on one side by panel 56 (shown cutaway in FIG. 2A). Panels 53 and 56 are secured to body 45 by fasteners such as screws but are removable therefrom to permit the cable 22 to be properly placed on the support assembly 23.

The support arms 47 pivotally mounted in the upper extremity of the body 45 in combination form a spider for securing the support assembly in the drill string 12. In the secured position, the arms 47 extend radially outwardly as illustrated and rest on the box end 57 of a drill pipe section. The arms 47, however, are pivotable downwardly into suitable slots formed in the body 45 to permit the assembly to be retrieved from the drill string 12 if desired. A central opening extends from opening 54 through the upper nose end 55 of the body 45. A side opening slot (not shown) provides access to the nose opening permitting the cable 22 to be placed therein. The upper support assembly 23 also includes a cable gripping device 40. A cable gripping device suitable for use in the present invention is described in U.S. Pat. No. 3,957,118.

Figure 2B:
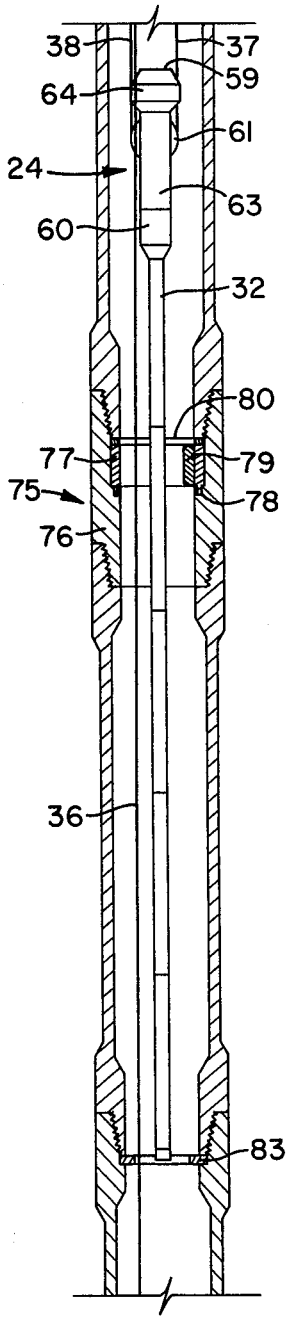

As shown in FIG. 2B, the lower pulley assembly 24 includes body 60, sheave 61 journaled for free-wheel rotation on the body 60, and long weight 32. The sheave 61 is mounted on the body 60 in an opening which is closed on one side by removable panel 63.

Referring also to FIG. 2A, the lower end of body 45 is tapered to mate with a complementary-shaped concave upper end 59 of body 60. Cable guides 50 and 64 are also provided near the lower end of body 45 and upper end of body 60, respectively. The guides 50 and 64 are each provided with three aligned cable openings.

The cable 22 extends (from top to bottom) through the nose end 55 of body 45, between guide rollers 48 and 49, through guides 50 and 64, down and around sheave 61, back through guides 50 and 64, up and around sheave 46, down through cable gripping device 40, through guides 50 and 64, and finally down to the instrument 21 anchored in the drill string 12. The overlapped cable portions provided by assemblies 23 and 24 are designated by the same reference numerals (36, 37, and 38) schematically illustrated in FIG. 1.

As mentioned previously, the lower pulley assembly 24 and weight 32 are suspended on a looped portion, e.g. portions 37 and 38, of the cable 22 and are movable axially within the pipe string 12 by the introduction or withdrawal of cable at the surface. The guide assemblies 75, which are preferably inserted at each pipe joint over the cable storage interval, prevent weight 32 and lower asselby 24 from rotating relative to both upper assembly 23 and drill string 12.

Figure 3:
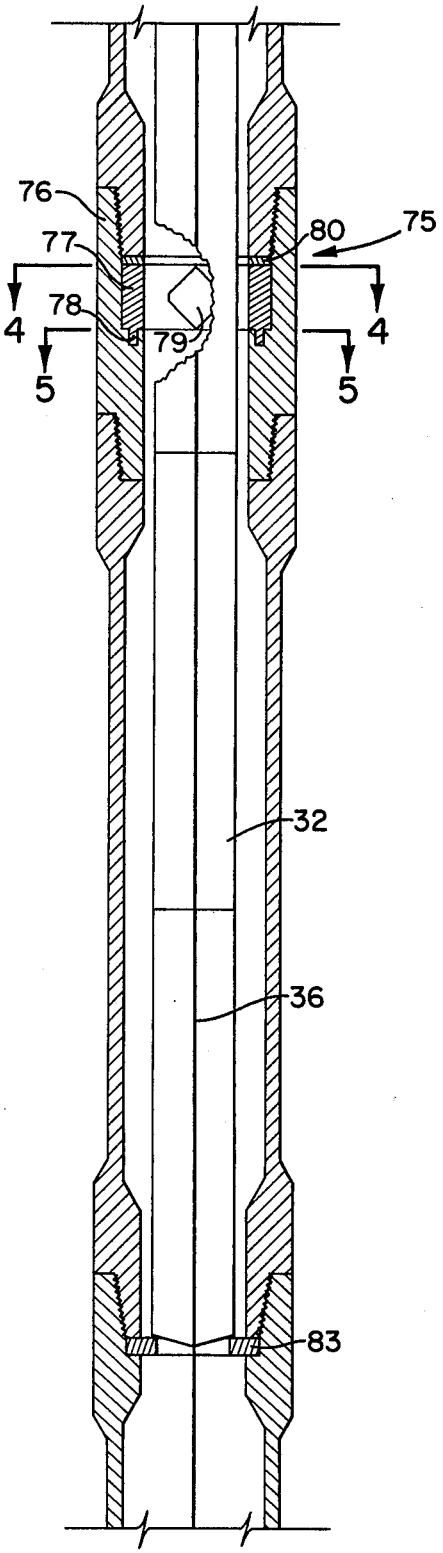
FIG. 3 is an enlarged, sectional, front elevational view of a portion of FIG. 2, partially cutaway, illustrating details of the guide ring and flat weight.
Figure 4:
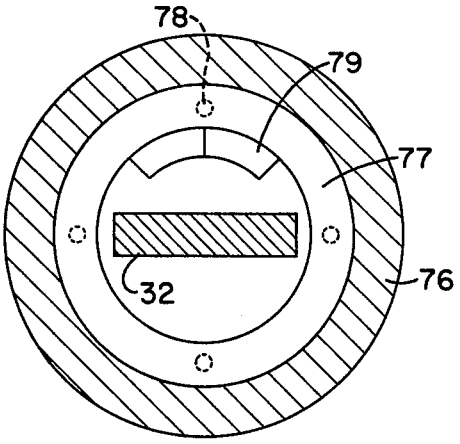
FIG. 4 is a transverse sectional view of apparatus shown in FIG. 2B, with the cutting plane taken generally through line 4—4 thereof.
Figure 5:
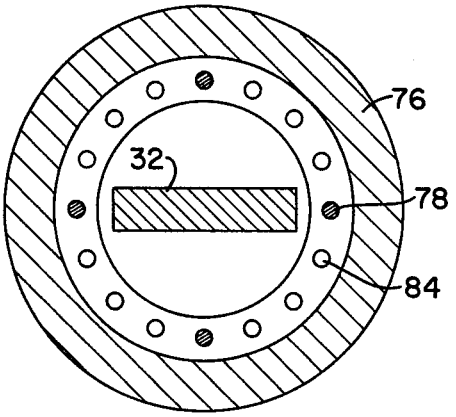
FIG. 5 is a transverse sectional view of the apparatus shown in FIG. 2B, with the cutting plane taken generally through the line 5—5 thereof.

Referring to FIGS. 2B and 3, weight 32 comprises several flat, rectangular steel sections which are assembled and inserted into drill string 12 to form a long, thin, rectangular-shaped strip of sufficient weight to provide tension on the overlapped cable portions 37 and 38. Guide assemblies 75 include a guide ring sub 76, guide ring 77 having locator pins 78 and rotation limiting sector 79 formed therein, and tension ring 80. (A "sub" is a short threaded piece of pipe for insertion into a drill string.) As seen in FIG. 4, the rotation limiting sector 79 preferably defines an arc of about 120° around the inside circumference of guide ring 77. The arc may be between about 80° and about 160°, however. Outside these limits, the flat weight either becomes stuck or the limiting sector is ineffective in preventing rotation, or extraordinary care is required to align the sectors.

As more clearly seen in the cutaway portion of FIG. 3, the rotation limiting sector 79 is generally diamond-shaped and extends radially inwardly from the cylindrical surface of the drill string 12. The thickness of the rotation limiting sector depends on the diameter of the drill pipe 12 and the width of the weight 32. The distance between a point on the surface of the rotation limiting sector 79 and an opposite point on the guide ring 77 should be less than the width of weight 32. A no-go ring 83 is installed in a pipe joint at the lower limit of travel of weight 32 to prevent any of the cable storage components from falling to the bottom of the hole in the event of accidental cable separation.

Figure 6:
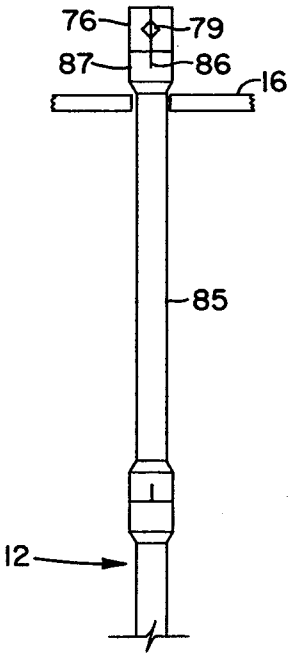

With particular reference to the schematic illustrations of FIGS. 6-9, installation of the guide ring assemblies 75 and storage of cable within drill string 12 may be accomplished according to the following procedure. Initially, box ends of each section of drill pipe to be added when installing guide assemblies are inscribed to provide aligned index marks. The top-most pipe section 85 of drill string 12 is suspended at rotary table 16 (FIG. 6). Pipe section 85 has an index mark 86 inscribed on the upper box end 87 of the drill pipe section 85.

With reference also to FIGS. 2B, 3, 4 and 5 for details in the construction of guide assemblies 75, a guide ring sub 76 is threadably connected to the suspended drill pipe section 85 under proper torque. Guide ring 77 is placed within guide ring sub 76, aligning the rotation limiting sector 79 with the index mark 86 on the box end 87 of the suspended pipe section 85. Guide ring 77 is prevented from rotating within sub 76 by engagement of locator pins 78 with locator pin holes 84 (See FIG. 5). A tension ring 80 is then inserted above guide ring 77 to prevent further vertical movement, thereby minimizing wear on locator pins 78 and the lower edge of guide ring 77.

Figure 9:
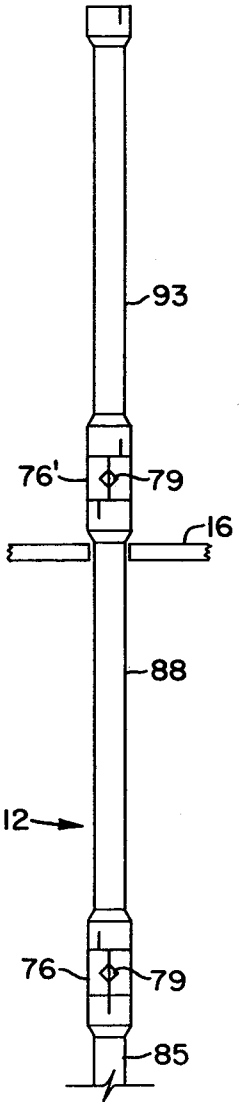
FIGS. 6–9 are schematic views illustrating a preferred sequence of steps for inserting guide rings in the pipe string.
Figure 8:
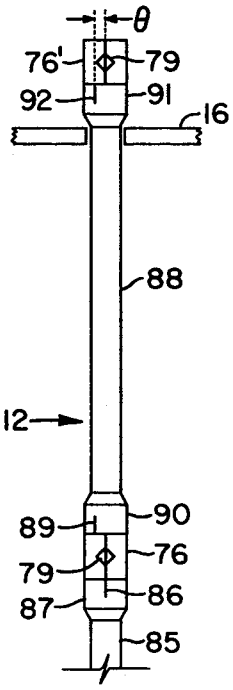
Figure 7:
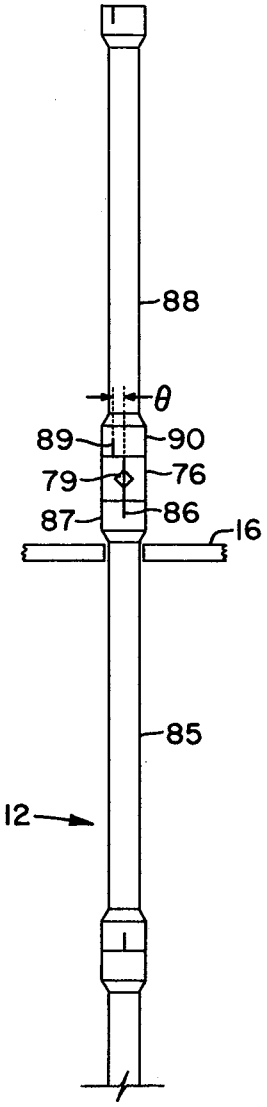

Another drill pipe section 88 is then threadably connected to the upper end of guide ring sub 76 and the appropriate connecting torque is applied (FIG. 7). The extent of angular displacement $\theta$ of index mark 89 on the lower box end 90 of pipe section 88 from initial index mark 86 is measured and the drill string 12 is lowered into borehole 17 (not shown) a distance equal to the length of the added pipe section 88 (FIG. 8). Once again, the entire drill string 12 is suspended at the upper box end 91 of the added pipe section 88 at rotary table 16 and another guide ring sub 76' threadably connected. A guide ring 77 is inserted in the guide ring sub 76' and oriented with the initially installed guide ring. This is accomplished by noting the position of the index mark 92 on the upper box end 91 of the added drill pipe section 88 (which corresponds to the angular position of index mark 89 at the lower box end 90) and circumferentially displacing the rotation limiting sector 79 of guide ring 77 in sub 76' from the index mark 92 through the angle $\theta$ (equal to the previously measured angular displacement). Another tension ring 80 is inserted as before. As indicated by FIG. 9, additional drill pipe sections (eg. pipe section 93) and guide assemblies 75 are added and oriented in the same manner to provide rotation limiting sectors 79 axially aligned with initial index mark 86 at each pipe joint over the cable storage interval. Alignment of the rotation limiting sectors 79 is important since otherwise weight 32, and the overlapped cable portions, would inherently be twisted as the stored cable was used up.

Once the guide ring assemblies 75 have been installed, the cable storage components may be inserted into the drill string 12 according to the following procedure, with reference to FIGS. 1, 2A and 2B. The cable 22, provided with a latching connector 33, is lowered into the drill string 12 and latched onto instrument 21 such that tension may be pulled on the cable 22. Further, the connection is such that release occurs by application of a preset upward force.

The cable 22 is then positioned on the upper and lower assemblies 23 and 24. These assemblies along with flat weight 32 are introduced into the drill string 12. The support arms 47 are placed on the supporting shoulder of the box end 81 of the top pipe joint. The cable 22 thus extends from instrument 21 up to and around the top sheave 46, down and through the cable gripping device 40, down and around the bottom sheave 61, up and through the nose end 55 of body 45. A force is then pulled on the cable 22 at the surface to apply tension on cable portion 36. The lower pulley assembly 24 is raised until its upper end 59 mates with the lower end 58 of support assembly 23. Additional force tightens the cable 22 around the various sheaves and guide rollers and applies a tensile force on cable portion 36 which is maintained by cable gripping device 40.

After the cable is properly tensioned, additional cable 22 is unreeled and introduced into the drill string 12. This lowers the lower pulley assembly 24 and weight 32 within the drill string 12, forming long overlapped portions 37 and 38 which as noted above constitute stored cable. The weight 32 is automatically positioned in the drill string 12 by the rotation limiting sectors 79. If the weight 32 is twisted and improperly positioned relative to a given rotation limiting sector 79, correction is provided as the weight 32 slides down the angled portion of the diamond-shaped rotation limiting sector 79. The cable may be introduced until the weight 32 encounters no-go ring 83, indicating that the proper amount of cable has been stored. A connector 34 is then connected to the upper terminal end of cable 22. This connector 34 and drill string are connected to the kelly cable 25 and kelly 11, respectively, placing the system in condition to commence drilling and telemetry operations.

Intelligence from the instrument 21 is transmitted through conductors 22, 25 and 27 to receiver 28. The drill string 12 is periodically lengthened by the addition of pipe sections and the cable 22 is lengthened the same amount by withdrawing stored cable. This procedure may continue until the stored cable has been used up, which occurs when the lower pulley assembly 24 engages the upper support assembly 23. Excess cable may be restored by introducing additional cable to the drill string 12. This lowers the lower pulley assembly 24 within the pipe string 12. Alternatively, the cable system may be retrieved. With the drill string 12 suspended in the rotary table 16 and with the kelly 11 and kelly cable 25 disconnected from the drill string 12 and cable 22, a force is pulled on cable 22. This engages the lower pulley assembly 24 with the upper support assembly 23. The application of a pulling force then is transmitted to connector 33 via cable 22. When the pulling force exceeds a preset level, connector 33 releases from instrument 21 permitting the cable 22 and assemblies 23 and 24 to be withdrawn.

Although the present invention has been described with reference to conventional rotary drilling operations, it can also be used with other types of drilling equipment including turbo-drills and positive displacement hydraulic motors. These devices normally include a motor or turbine mounted on the lower end of a drill string and adapted to connect to and drive a bit. The motor or turbine powered by the drilling fluid drives the drill bit while the drill string remains stationary. When this type subsurface drilling device is used in directional drilling operations, the present invention provides a highly useful means for transmitting directonal data to the surface.

What is claimed is:

1. In a cable mounting method for wellbore telemetry wherein an electric cable extends from a subsurface location within a rotary pipe string to an upper support assembly, from said upper support assembly downwardly to a lower pulley asembly, and from said lower pulley assembly upwardly to the surface, said cable being anchored at said subsurface location, the improvement comprising mounting rotation limiting means at selected pipe joints over a predetermined interval of said pipe string, and extending a rectangular weight from said lower pulley assembly downwardly in said pipe string more than the distance between adjacent rotation limiting means.

2. The method as defined in claim 1, further including the step of axially aligning said rotation limiting means relative to each other.

3. In a method for maintaining electric continuity between a subsurface location and the surface in a pipe string wherein a cable is mounted in said pipe string to extend from a subsurface instrument up to and around an upper support assembly secured to said pipe string down to and around a lower pulley assembly and to the surface, said lower pulley assembly being free to move within said pipe string, the improvement which comprises, mounting a plurality of guide assemblies at longitudinally spaced intervals along said pipe string, securing a weight to said lower pulley assembly, said weight being longer than the spacing between adjacent guide assemblies and being prevented from rotating relative to said pipe string by said guide assemblies.

4. In a cable system for wellbore telemetry which includes a cable arranged in a pipe string to extend from a subsurface location in said pipe string to an upper support assembly, from said upper support assembly to a lower pulley assembly, from said lower pulley assembly to the surface, and further includes means for maintaining the portion of cable which extends from said subsurface location to said upper support assembly in tension, the improvement which comprises means for limiting rotation of said lower pulley assembly inserted at several joints over a selected interval in said pipe string, and a rectangular weight attached to said lower pulley assembly, said weight having a length greater than the distance between adjacent pipe joints containing said rotation limiting means and a width such that said weight engages said rotation limiting means upon rotation relative to said pipe string.

5. In a cable system for conducting telemetry operations between a subsurface location and the surface in a pipe string which includes a cable extending within said pipe string, from said subsurface location up to and around an upper support assembly secured to said pipe string down and around a lower pulley assembly, and upward to the surface, the improvement wherein said pipe string includes a plurality of rotation limiting assemblies spaced longitudinally in said pipe string, and said lower pulley assembly includes a longitudinal weight which extends within said pipe string a distance at least equal to the spacing of adjacent rotation limiting assemblies, said rotation limiting assemblies each being operative to prevent rotation of said weight relative to said pipe string.

6. A system as defined in claim 5 wherein said weight comprises a plurality of rectangular sections attached to one another in lengthwise fashion.

7. A system as defined in claim 5 wherein each of said rotation limiting assemblies includes a hollow, cylindrical sub capable of being threadably connected to a pipe section of said pipe string, and a tubular member having a circumferential section extending radially inwardly, said tubular member being disposable within said sub.

8. A system as defined in claim 7 wherein said sub and said tubular member interengage such that relative rotation is prevented.

9. The system of claim 7 wherein said circumferential section defines an arc of between about 80° and about 160°.

10. The system of claim 9 wherein said arc is about 120°.

11. A system as defined in claim 5 which further includes means for axially aligning said rotation limiting assemblies relative to one another.

12. A system as defined in claim 5 which further includes means for preventing said weight from moving below a selected depth in said pipe string.

13. A cable system for wellbore telemetry which includes:

a rotary pipe string;

an electrical cable;

means for anchoring a lower end of said cable at a subsurface location in the rotary pipe string;

an upper support assembly supported in said pipe string;

a lower pulley assembly disposed in said pipe string below said upper support assembly, said cable extending from said subsurface location up to said upper support assembly, around said upper support assembly, down to said lower pulley assembly, and upward to the surface, said upper support assembly including a cable gripping device for tensioning the cable portion between said subsurface location and said upper support assembly;

a flat weight attached to said lower pulley assembly axially extending more than the length of a pipe section; and means for preventing said flat weight from rotating relative to said pipe string when inserted at a plurality of pipe joints over a selected interval in said pipe string.

* * * * *